US006036820A

United States Patent [19]

Schiel et al.

[11] Patent Number: 6,036,820

[45] Date of Patent: Mar. 14, 2000

[54] SHOE PRESS UNIT

[75] Inventors: Christian Schiel, Murnau; Joachim Grabscheid, Heuchlingen; Wolfgang Schuwerk, Kisslegg; Rudolf Hasenfuss, Herbrechtingen, all of Germany

[73] Assignee: Voith Sulzer Papiermaschinen GmbH, Heidenheim, Germany

[21] Appl. No.: 09/057,547

[22] Filed: Apr. 9, 1998

[30] Foreign Application Priority Data

Apr. 10, 1997 [DE] Germany ..... 197 14 939

[51] Int. Cl.[7] ..... D21F 3/00; D21H 11/00; B30B 3/00

[52] U.S. Cl. ..... 162/358.3; 162/361; 100/153

[58] Field of Search ..... 162/358.3, 358.4, 162/358.5, 361; 100/153, 162 B

[56] References Cited

U.S. PATENT DOCUMENTS

| | | |
|---|---|---|
| 4,568,423 | 2/1986 | Laapotti . |
| 5,167,768 | 12/1992 | Cronin et al. . |
| 5,650,048 | 7/1997 | Swietlik . |

FOREIGN PATENT DOCUMENTS

| | | |
|---|---|---|
| 2154317 | 1/1996 | Canada . |
| 3336462 | 4/1984 | Germany . |
| 4425915 | 2/1996 | Germany . |
| 19631638 | 2/1998 | Germany . |

OTHER PUBLICATIONS

Copy of a German Search Report dated Jul. 1, 1997.

Kotitschke, "Neue Generation von Nasspressen für Kraftliner und Testliner," *Wochenblatt für Papierfabrikation*, No. 22, pp. 831–837 (1984).

*Primary Examiner*—Peter Chin
*Assistant Examiner*—Dionne A. Walls
*Attorney, Agent, or Firm*—Greenblum & Bernstein P.L.C.

[57] ABSTRACT

Shoe press unit and method for treatment of a fibrous pulp web. The shoe press unit includes at least one press shoe, an opposing surface, a flexible press belt guided over the press shoe, and at least one force element composed of a cylinder/piston unit supported on a carrier. The at least one force element presses the press belt against the opposing surface to form a press zone elongated in a web run direction, and the cylinder/piston unit include a pressure chamber having at least one pair of cylinder/piston subunits successively positioned in the web run direction. Pressure fluid lines are coupled to respective ones of the at least one pair of cylinder/piston subunits to separately supply pressure fluid to each cylinder/pressure subunit to impart a tilting moment long a tilt axis substantially perpendicular to the web run direction. The method includes supplying a pressure fluid to a first and second pressure fluid line from a common pressure fluid source at a source pressure, supplying pressure fluid through the first pressure fluid line at a first fluid pressure to a first subunit of the at least one pair of cylinder piston subunits, supplying pressure fluid through the second pressure fluid at a second fluid pressure to a second subunit of the at least one pair of cylinder piston subunits, and maintaining a sum of the first and second fluid pressures to be substantially equal to the source pressure.

35 Claims, 4 Drawing Sheets

SHOE PRESS UNIT

CROSS-REFERENCE TO RELATED APPLICATIONS

The present application claims priority under 35 U.S.C. § 119 of German Patent Application No. 197 14 939.1, filed on Apr. 10, 1997, the disclosure of which is expressly incorporated by reference herein in its entirety.

BACKGROUND OF THE INVENTION

1. Field of the Invention

The present invention relates to a shoe press unit of a paper or cardboard machine for treatment of a fibrous pulp web in a press zone formed with an opposing surface and elongated in web run direction. The shoe press unit includes at least one press shoe, a flexible press belt guided over the press shoe, and at least one force element supported on a carrier. The at least one force element, which is formed by a cylinder/piston unit, presses the press belt against the opposing surface.

The present invention also relates to a method for tilting at least one press shoe in a press shoe unit for treatment of a fibrous pulp web in a press zone.

2. Discussion of Background Information

In known shoe press units, it is possible to predetermine an average, optimal distribution of pressure that is self-adjusting in the web run direction or to predetermine the adjustability of this pressure profile so that the pressing power can be altered over the length of the press zone with a same linear (line) force. In the latter case, the adjustability of the pressure profile is obtained, e.g., via a step-by-step displacement of the press shoe relative to a resultant force of the pressing; via a pressing of the shoe using two rows of pressing cylinders imparted with different pressures; or via introducing a torque moment without altering the line force, as discussed in German Patent Application No. DE 196 31 638.3.

However, these types of shoe press units have a number of disadvantages. For example, a practical need to change a pressure profile curve exists in only a very few cases. Thus, the advance expenditure for providing a tiltable (inclinable) press shoe arrangement is not even necessary with most applications of the shoe press roll. Further, the use of two rows of pressing cylinders imparted with different (differentiating) pressure can result in damage due to the more complex pressure control of both rows of cylinders. Imparting a tilt moment in the press shoe without altering the pressing force, e.g., in accordance with DE 196 31 638.3, is a better and more secure manner, however, the necessary expenditure is relatively high. Still further, a relatively large space within the press roll interior is lost due to the necessary elements for imparting the tilt on the press shoe. The elements in the roll interior are generally built or provided around a tilt lever so that a relatively large advance capital expenditure must be made if one seeks to expand a standardized construction to include the capability of tilting the press shoe.

The step-by-step displacement of the shoe relative to a level of the resulting force brings with it further disadvantages, e.g., that the levels are too large as a condition of the construction and that the machine must be turned off to displace the shoe. This results in a corresponding loss in production.

SUMMARY OF THE INVENTION

The present invention provides an improved shoe press unit of the above-mentioned type that optionally enables control of the pressure profile with a reduced cost expenditure and correspondingly higher reliability, without suffering from the above-mentioned disadvantages.

The present invention provides a shoe press unit that includes at least a pair of cylinder/piston subunits in the pressure chamber of a cylinder/piston unit of at least one force element. The pair of cylinder/piston subunits are successively arranged (i.e., adjacent or subsequent to one another) in a web run direction and may be supplied with pressure fluid via separate pressure fluid lines to impart a tilting moment on the press shoe around a respective tilt axis. The respective tilt axis may extend substantially vertically to the web run direction.

Due to the specific design of the present invention, optional control of a pressure profile that adjusts itself in a press nip (opening) in a feed direction of the fibrous pulp web is possible in a simple manner. The control of the pressure profile may be achieved without necessitating displacement of a direct point of applied force, which may adversely strain the press shoe in the direction of the press nip. In addition, a respective profile tilting is free of errors associated with automatic adjusting, which could appear in the prior art double-spaced cylinder arrangements. The control of tilting moments during operation is possible, and practically without errors, without changing the line force. Further, bulky, additional parts are no longer necessary.

In particular, in accordance with the present invention, an operation may be performed in which the principle of uniform pressure is maintained unaltered, i.e., a uniform hydraulic pressure from a same pressure source for an upper and a lower roll is guaranteed to substantially avoid bearing forces of a mating roll which are too high. Moreover, the possibility of an optional special installation is provided in which only the noted parts can be installed, without modifying the standard construction. In particular, a subsequent upgrading for an inclinable embodiment is also possible, when inclinability (or tiltability) is desired at a later date. The advance expenditure made with a standard system, i.e., keeping in mind the possibility of a subsequent upgrading, is reduced to a minimum. Finally, the possibility of a simple, adjustable tilt that can be reproduced is also provided.

Depending on the practical application desired by the user, the present invention may be realized even if only part of the exemplary practical installation possibilities are utilized. Should the line forces remain constant and be retained after an initial optimization of a respective tilt adjustment, then it is not necessary that the tilting be reproducibly adjustable.

For obtaining a particularly compact construction, the cylinder/piston subunits may preferably be integrated into a respective force element. For this, a minimal adaption of the present machine parts should be made, if necessary.

It may be advantageous to position several pairs of cylinder/piston subunits to lie adjacent to one another and to be arranged transversely to the web run direction, to form two rows of cylinder/piston subunits successively arranged in the web run direction. Thus, the cylinder/piston subunits of a respective row can be imparted upon, e.g., preferably via a common pressure fluid line.

It may be advantageous if the fluid pressures, supplied to both subunits of a respective pair of cylinder/piston subunits, are guided or controlled so that a sum of both fluid pressures remains constant. As a result, the line force in equally large piston surfaces is unaltered in both lines while the pressure profile curve is modified in the press zone by a tilt.

In an exemplary embodiment of the shoe press unit in accordance with the present invention, only a fraction of the entire force is applied via the cylinder/piston subunits. Even greater control accuracies thus have practically no influence upon the respective operation. This may be particularly true when hydraulic supports of the shoe press unit, as well as a mating roll working in conjunction with it, are supplied from a common pressure source. In this manner, damage to the rolling bearing of the mating roll, which works in conjunction with the shoe press unit and which is hydraulically supported, is substantially avoided due to diversions of the actual pressures from the target pressures. For the attainment of a respective tilt, both rows of the cylinder/piston subunits are, if applicable, to be suppled with differentiated (differential) pressures via a corresponding pressure regulation device. If only a fraction of the entire force is summoned by the cylinder/piston subunits, the present invention practically eliminates increasing control accuracies, which may hereby appear, from leading to greater forces which strain the roll bearings.

In an expedient manner, at most approximately 25%, and preferably between approximately 7.5% and 15%, of the entire force is applied by the cylinder/piston subunits.

In an exemplary application, it may be advantageous if the fluid pressures supplied to both subunits of a respective pair of cylinder/piston subunits are guided or controlled, such that a relationship between the fluid pressure supplied to the pressure chamber of the force element and the sum of the fluid pressure supplied to both subunits remains substantially constant. A control device that controls the fluid pressures of the cylinder/piston subunits can be provided so that a sum of the force of the cylinder/piston subunits changes analogously to the line force. In this manner, a disadvantageously high strain of the bearing arrangement of a hydraulically supported mating roll is substantially avoided.

With another advantageous embodiment of the shoe press unit in accordance with the present invention, the piston of at least one cylinder/piston subunit may be set in a press piston of the force element in a tiltable and sealing manner in a base-side pocket hole and in another cylinder bore hole aligned with it.

Thus, the pistons of a respective cylinder/piston subunit may be equipped with a continuous flow channel, to connect the base-side pocket bore hole, which can be imparted upon with pressure fluid, to a segment on the press shoe side of the cylinder bore hole in the pressing piston.

The base-side pocket bore hole and the cylinder bore hole in the pressing piston can expediently have an equally large diameter. The piston of the cylinder/piston subunit may then hang free of axial force as a connection between the carrier and the pressing piston.

An axial hub of the piston of a respective cylinder/piston subunit may be limited by elements provided preferably on the base-side. For example, a limitation of the hub to a few millimeters is contemplated and possible.

In a practical embodiment, a flow channel, which goes through the piston of a respective cylinder/piston subunit may be formed so that it connects the base-side, pocket bore hole to the segment on the press shoe side of the cylinder hole in the pressing piston, at least substantially without throttling. The respective pressure acts directly upon the press shoe, such that uniformity of the force is improved. In addition, the friction force between the shoe and the pressing piston is reduced.

The pressure fluid supply of the cylinder/piston subunits and/or one or more force elements may advantageously proceed via a base-side distribution strip that extends transversely to the web run direction and that is equipped with separate pressure fluid channels. This distribution strip may be set in a recess formed in the carrier and may extend transversely to the web run direction. In this manner, at least one part of the pressure fluid channels may be formed between the strips and the inner periphery of the recess.

Another practical embodiment of the shoe press unit in accordance with the present invention provides that both subunits of a respective pair of cylinder/piston subunits, and, if appropriate, both rows of cylinder/piston subunits, may be supplied via a common pressure fluid source. In this manner, a cylinder/piston subunit of a respective pair or a row of subunits are coupled to the common pressure fluid source via a pressure regulator and the other subunit of the respective pair or the other row of subunits are coupled to the common pressure fluid source via a flow limiter. Further, the cylinder/piston subunits are connected to a common addition valve, in order to maintain the sum of the fluid pressures, directed to both subunits of a respective pair or upon both the rows of subunits, constant under a constant line force during the tilting. In this manner, the desired tilting moment can be adjusted through the pressure regulator (governor).

The addition valve may be coupled to the pressure chamber of one or more force elements via a pressure fluid line equipped with a flow regulator and formed so that the relation is kept constant between the fluid pressure, imparted upon the respective pressure chamber of one or more force elements, and the sum of the fluid pressures, imparted upon both subunits of a respective pair or both the rows of subunits. The flow regulation can include, e.g., a flow regulator, a fixed throttle, and/or a throttle, whose adjustment alters with the line force produced in the press zone.

The pressure chamber of the force element is preferably supplied via a separated pressure fluid source.

The shoe press unit can, e.g., be formed as a shoe press roll with a press jacket that forms a flexible press belt.

The present invention is directed to a shoe press unit for treatment of a fibrous pulp web. The shoe press unit includes at least one press shoe, an opposing surface, a flexible press belt guided over the press shoe, and at least one force element composed of a cylinder/piston unit supported on a carrier. The at least one force element presses the press belt against the opposing surface to form a press zone elongated in a web run direction, and the cylinder/piston unit include a pressure chamber having at least one pair of cylinder/piston subunits successively positioned in the web run direction. Pressure fluid lines are coupled to respective ones of the at least one pair of cylinder/piston subunits to separately supply pressure fluid to each cylinder/pressure subunit to impart a tilting moment along a tilt axis substantially perpendicular to the web run direction.

In accordance with another feature of the present invention, the at least one pair of cylinder/piston subunits are integrally formed in the at least one force element.

In accordance with another feature of the present invention, the at least one pair of cylinder/piston subunits include a plurality of pairs of cylinder/piston subunits adjacently positioned transversely to the web run direction to form two rows of cylinder/piston subunits successively arranged in the web run direction. Further, a respective row of the plurality of pairs of cylinder/piston subunits are coupled to a common pressure fluid line.

In accordance with still another feature of the present invention, the shoe press unit further includes a control device that maintains a fluid pressure of the pressure fluid supplied to both subunits of a respective pair of cylinder/piston subunits so that a sum of the fluid pressures is constant.

In accordance with another feature of the present invention, of the entire force exerted by the at least one press shoe, less than the entire force is exerted by the cylinder/piston subunits. Further, at most approximately 25% of the entire force is exerted by the cylinder/piston subunits, and in particular, between approximately 7.5% to 15% of the entire force is exerted by the cylinder/piston subunits.

In accordance with a further feature of the present invention, a control device is included that maintains a fluid pressure of the pressure fluid supplied to both subunits of a respective pair of cylinder/piston subunits so that a relationship between the fluid pressure acting on the press chamber of the at least one force element and the a sum of the fluid pressures is constant.

In accordance with still another feature of the present invention, the at least one force element includes a pressing piston having a cylinder bore hole, the carrier includes a base-side pocket bore hole aligned with the cylinder bore hole and a piston of the at least one pair of cylinder/piston subunit is set in the pressing piston in a tiltable and sealing manner in the base-side pocket bore hole and in the cylinder bore hole. Further, the piston of the at least one pair of cylinder/piston subunits includes a continuous flow channel that couples the base-side pocket bore hole to a segment of the cylinder bore hole. Still further, the base-side pocket bore hole and the cylinder bore hole have substantially equal diameters.

In accordance with a still further feature of the present invention, a piston of the at least one pair of cylinder/piston subunits includes an axial hub formed on a carrier side of the piston.

In accordance with another feature of the present invention, the at least one force element includes a pressing piston having a cylinder bore hole, the carrier include a base-side pocket bore that is arranged to align with the cylinder bore hole and a piston of the at least one pair of cylinder/piston subunits includes at least one flow channel that couples the base-side pocket bore hole at least substantially without throttling to a segment of a cylinder bore hole on the press shoe side.

In accordance with still another feature of the present invention, a base-side distribution strip is included that extends transversely to the web run direction and includes pressure fluid channels. The pressure fluid channels are coupled to supply pressure fluid to at least one of the at least one pair of cylinder/piston subunits and the pressure chamber of the at least one force element. The carrier includes a recess extending transversely to the web run direction to receive a portion of the distribution strip and at least a portion of the pressure fluid channels is preferably formed between the distribution strip and the interior periphery of the recess.

In accordance with a further feature of the present invention, the at least one pair of cylinder/piston subunits includes a first and second subunit, the first and second subunits being supplied with pressure fluid through a common pressure fluid source. The shoe press unit further includes a pressure governor coupling the common pressure fluid source to the first subunit, a flow limiter coupling the common pressure fluid source to the second subunit, and a common addition valve coupled to the first and second subunits to maintain a constant sum of fluid pressures supplied to the subunits. The pressure governor controls the desired tilting moment. Further, the addition valve is coupled to the pressure chamber of the at least one force element via a pressure fluid line with a flow regulation device. The addition valve maintains substantially constant a relationship between the fluid pressure imparted upon the pressure chamber and the sum of the fluid pressures supplied to the first and second subunits. Still further, the flow regulation device includes at least one of a flow regulator, a fixed throttle, and a throttle that is adjustable in accordance with a line force produced in the press zone.

In accordance with a still further feature of the present invention, the at least one pair of cylinder/piston subunits includes a plurality of pairs of cylinder/piston subunits adjacently positioned transversely to the web run direction to form first and second rows of cylinder/piston subunits successively arranged in the web run direction, the first and second rows being supplied with pressure fluid through a common pressure fluid source. The shoe press unit further includes a pressure governor coupling the common pressure fluid source to the first row, a flow limiter coupling the common pressure fluid source to the second row, and a common addition valve coupled to the first and second rows to maintain a constant sum of fluid pressures supplied to the rows. The pressure governor controls the desired tilting moment. Further, the addition valve is coupled to the pressure chamber of the at least one force element via a pressure fluid line with a flow regulation device. The addition valve maintains substantially constant a relationship between the fluid pressure imparted upon the pressure chamber and the sum of the fluid pressures supplied to the first and second rows. Still further, the flow regulation device includes at least one of a flow regulator, a fixed throttle, and a throttle that is adjustable in accordance with a line force produced in the press zone.

In accordance with still another feature of the present invention, the pressure chamber being supplied with pressure fluid from a separate pressure fluid source.

In accordance with a further feature of the present invention, the shoe press unit includes a shoe press roll and a press jacket forming the flexible press belt.

In accordance with a still further feature of the present invention, a pressure governor coupled to a first and second subunit of the at least one pair of cylinder/piston subunits is included. The pressure governor includes a stepped piston element having a first, second and third surface area arranged maintain the relation:

$$p_1 \cdot A_1 = p_2 \cdot A_2 + p_3 \cdot A_3.$$

In this relation, $p_1$ represents the pressure imparted on the pressure chamber; $A_1$ represents the area of the first surface; $P_2$ represents the pressure imparted on the first subunit; $A_2$ represents the area of the second surface; $p_3$ represents the pressure imparted on the second subunit; and $A_3$ represents the area of the third surface.

The present invention is directed to a method for imparting a tilting moment on at least press shoe of shoe press unit for treatment of a fibrous pulp web. The shoe press unit includes the at least one press shoe, an opposing surface, a flexible press belt guided over the press shoe, at least one force element composed of a cylinder/piston unit supported on a carrier, the at least one force element to press the press belt against the opposing surface forming a press zone elongated in a web run direction, the cylinder/piston unit including a pressure chamber having at least one pair of cylinder/piston subunits successively positioned in the web run direction, and pressure fluid lines coupled to respective ones of the at least one pair of cylinder/piston subunits. The method includes supplying a pressure fluid to a first and second pressure fluid line from a common pressure fluid source at a source pressure, supplying pressure fluid through the first pressure fluid line at a first fluid pressure to a first subunit of the at least one pair of cylinder piston subunits, supplying pressure fluid through the second pressure fluid at a second fluid pressure to a second subunit of the at least one pair of cylinder piston subunits, and maintaining a sum of the first and second fluid pressures to be substantially equal to the source pressure.

In accordance with another feature of the present invention, the method farther includes separately supplying a pressure fluid at a chamber fluid pressure to the pressure chamber. The method also includes maintaining a relationship between the chamber fluid pressure and the sum of the first and second fluid pressures supplied to the first and second subunits.

In accordance with another feature of the present invention, the method includes arranging a plurality of pairs of cylinder/piston subunits transverse to the web run direction to form first and second rows of cylinder/piston subunits successively arranged in the web run direction, supplying the pressure fluid to the first and second rows from the common pressure fluid source at the source pressure, supplying the pressure fluid at the first fluid pressure to the first row, supplying pressure fluid at the second fluid pressure to the second row, and maintaining a sum of the first and second fluid pressures to be substantially equal to the source pressure. Further, the method includes supplying a pressure fluid at a chamber fluid pressure to each pressure chamber associated with the subunits from a separate pressure fluid source and maintaining a relationship between the chamber fluid pressure and the sum of the first and second fluid pressures supplied to the first and second rows.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
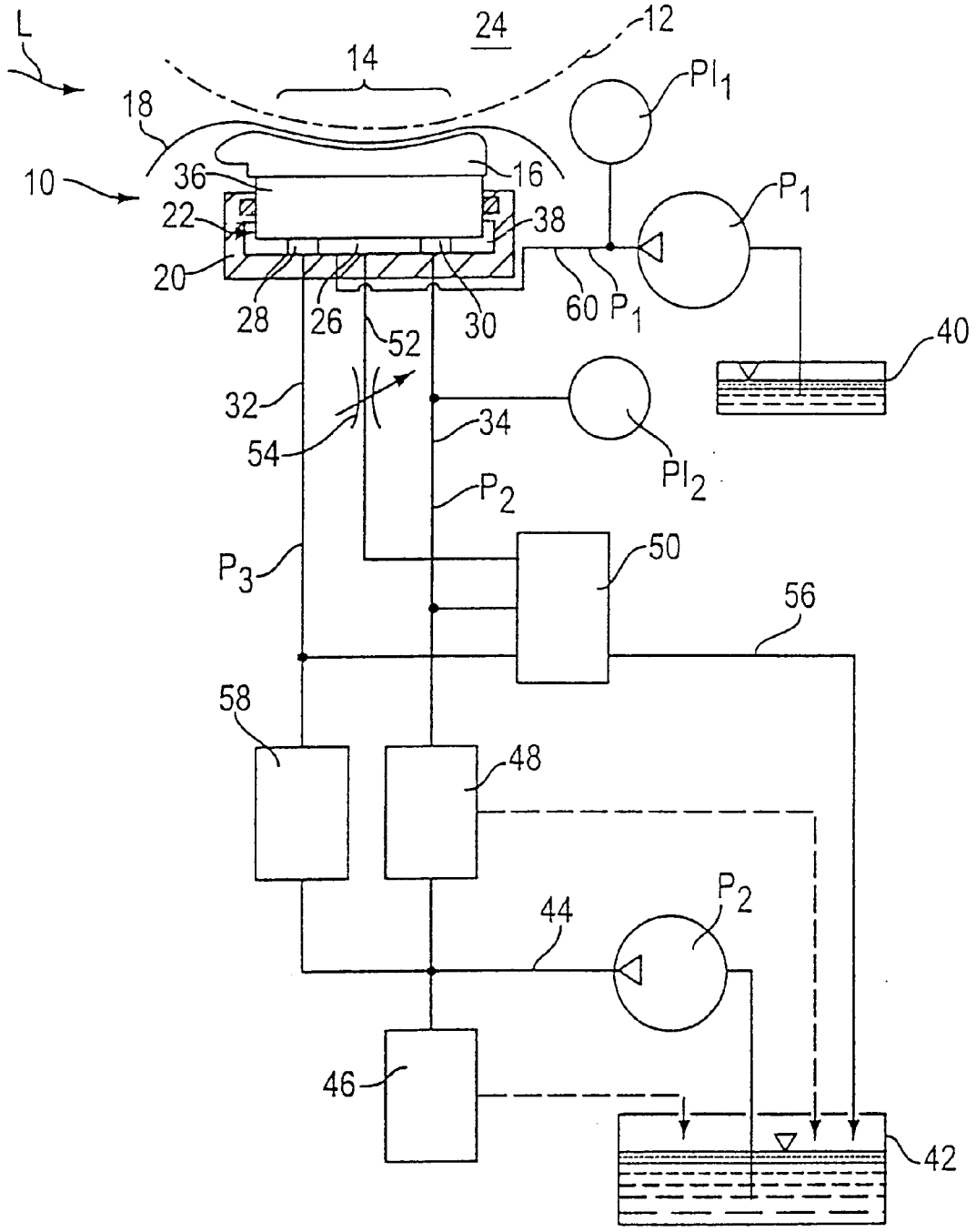
FIG. 1 illustrates a purely schematic, partially sectioned side-view of a shoe press unit that includes a disposed pressure fluid supply and a tilt control.

FIG. 1 illustrates, in a purely schematic, partially sectioned side-view, a shoe press unit 10 in the form of a shoe press roll with an associated pressure fluid supply and an associated tilt control. Shoe press unit 10 may be utilized in, e.g., a paper or cardboard machine to treat a fibrous pulp web in a press zone 14 formed by an opposing surface 12 and elongated in a web run direction L. Shoe press unit 10 may include at least one press shoe 16, a flexible press jacket 18, e.g., a flexible press belt, guided over press shoe 16, and at least one force element 22 formed by a cylinder/piston unit and supported on a carrier 20. The at least one force element 22, and, thereby press shoe 16, presses flexible press jacket 18 against opposing surface 12 of a mating roll 24.

Besides the fibrous pulp web, one or two felts may be guided through press zone 14 formed between press jacket 18 and opposing surface 12 of mating roll 24.

The cylinder/piston unit of the at least one force element 22 includes a pressure chamber 26 having at least one pair of cylinder/piston subunits 28 and 30. Cylinder/piston subunits 28 and 30 are successively arranged (i.e., subsequent to each other) in web run direction L and may be supplied (imparted upon) with pressure fluid, via separate pressure fluid lines 32 and 34, to impart a tilting moment to press shoe 16 on a tilting axis that is at least substantially perpendicular to web run direction L. Cylinder/piston subunits 28 and 30 may be integrated into force element 22.

Further, a plurality of pairs of cylinder/piston subunits 28 and 30 may be positioned transversely to web run direction L to form two rows of cylinder/piston subunits 28 and 30 successively arranged in web run direction L.

As shown in FIG. 1, force element 22 may include a pressing piston 36 arranged within a cylinder 38. Press shoe 16 may be pressed by one or several pistons 36 arranged in one or several cylinders 38. Cylinders 38 are preferably hydraulic cylinders.

A predominant portion of a resulting force may be produced through oil pressure in pressure chamber 26 of force element 22. The oil pressure may be built up by a pump $P_1$, and may be indicated by a pressure measuring or indicator device $PI_1$. Pump $P_1$ may suction oil from a supply or reserve in an oil container 40. For the sake of clarity, several elements of the hydraulic circuit not essential to the features of the present invention that are known to the ordinarily skilled artisan, e.g., control valves and reverse movement of the oil, have been omitted.

Both cylinder/piston subunits 28 and 30 can be supplied or imparted upon with differential pressures to exert a substantially same or constant total force on press shoe 16. A hydraulic pump $P_2$, which suctions oil from an oil container 42 and conveys the suctioned oil to a pressure line 44, creates or produces the pressure to be supplied to subunits 28 and 30. If a surplus oil flow occurs in pressure line 44, the surplus may be channeled back into oil container 42 through a system pressure limiter 46. Cylinder/piston subunit 30 may be supplied with adjustable pressure via a pressure governor (regulator) 48. The corresponding pressure exerted on subunit 30 may be indicated by a pressure measuring or indicating device $PI_2$. For example, the pressure imparted to subunit 30 via pressure governor 48 may be adjustable from a value of zero to a maximum value that is less than or equal to the system pressure in pressure line 44.

In accordance with the present invention, the sum of fluid pressures $p_2$ and $p_3$ in respective pressure fluid lines 34 and 32, i.e., $p_2+p_3$, that is supplied to both cylinder/piston subunits 30 and 28 is maintained or kept constant and proportional to pressure $p_1$ by an addition valve 50 coupled to pressure chamber 26 of cylinder 38 of one or more force elements 22. Because of the constant fluid pressure force exerted through the differential pressure fluid lines 32 and 34 on subunits 30 and 28, the higher the pressure $p_2$ in a pressure fluid line 34 leading to cylinder/piston subunit 30 and the lower the pressure $p_3$ in a fluid line 32 leading to cylinder/piston subunit 28, the higher the press force between press jacket 18 and mating roll 24 will be at the end of press zone 14 and, the lower the press force will be at the beginning of press zone 14.

A reference pressure may be taken from pressure chamber 26 through a connection line 52 coupling pressure chamber 26 and addition valve 50. Through connection line 52, flow regulation can be provided, e.g., via an adjustable throttle 54 to substantially hinder or reduce vibrations of addition valve 50.

Surplus oil may flow through from pressure fluid line 32 to addition valve 50 and through a return pipe 56 to the oil container 42.

Between pressure fluid line 44 and pressure fluid line 32 that leads to cylinder/piston subunit 28, a flow-through limiter 58 may be provided to prevent pressure in pressure line 44 from falling too sharply when pressures are adjusted in cylinder/piston subunits 30 that are significantly higher than the medium pressure $$\frac{p_3 + p_2}{2}.$$

Flow-through limiter 58 may be, e.g., a throttle or a volume governor having a regulated flow that is smaller than a required amount of pump $P_2$. Thus, even at a pressure "zero" in pressure fluid line 32 leading to cylinder/piston subunit 28, it is ensured that the maximum system pressure in pressure line 44 is preserved.

A desired tilt of press shoe 16, and, thereby, the pressure profile curve in press zone 14, may occur via pressure governor 48 controlling the pressure in pressure fluid line 34 leading to cylinder/piston subunit 30.

Addition valve 50 substantially maintains the sum $p_2+p_3$ of pressures $p_2$ and $p_3$, imparted upon cylinder/piston units 28 and 30 substantially constant at all times and substantially fixed relative to the pressure in pressure fluid line 60 leading to pressure chamber 26. The supplied pressures may be set by the piston surfaces of addition valve 50. Thus, the force working on press shoe 16 is not influenced by changing the tilting of press shoe 16 in the entire line force area when LK is between approximately 0 and $LK_{max}$.

Figure 2:
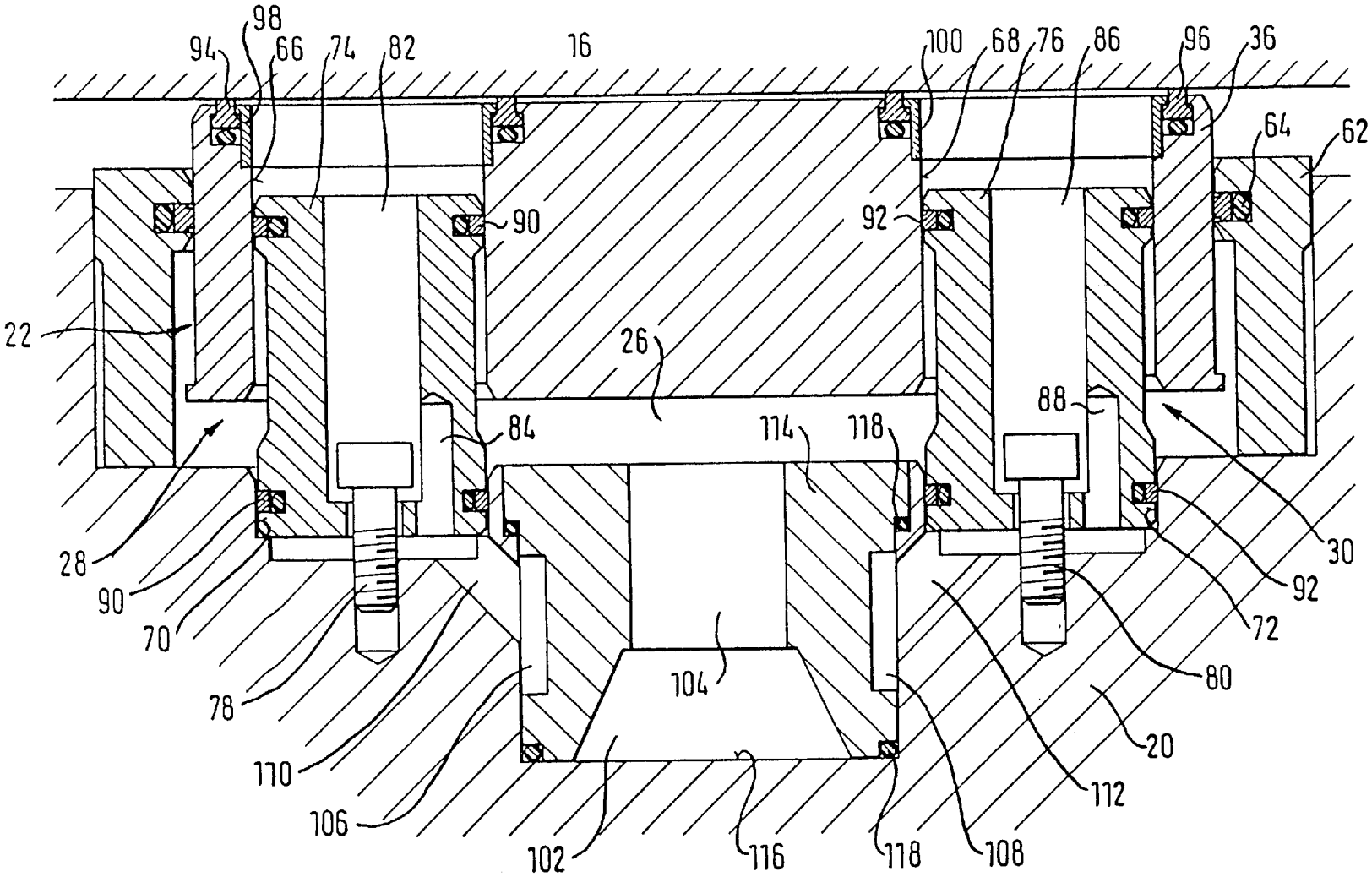
FIG. 2 illustrates a more detailed sectioned side-view of an embodiment of the shoe press unit.

In accordance with the exemplary embodiment of a shoe press unit illustrated in FIG. 2, a pressure piston in a cylinder block 62, that may be pressed against press shoe 16, is vertically displaceable and guided in an inclinable (tiltable) manner in an elastic seal 64.

Cylinder/piston subunits 28 and 30 include respective cylindrical bore holes 66 and 68 within pressure piston 36, and respective pocket bore holes 70 and 72 provided in carrier 20. In this manner, each cylinder/piston subunit 28 and 30 may be integrally formed, or contained within, within a single force element 22.

Pistons 74 and 76 are positioned within these bore holes to form double pistons. Pistons 74 and 76 are each coupled to carrier 20 and secured against larger vertical displacements by a base-side stop screw 78 and 80, respectively.

Bore holes 82 and 84 (associated with subunit 28) or bore holes 86 and 88 (associated with subunit 30) are provided to enable oil flow through pistons 74 and 76, respectively. Pistons 74 and 76 include elastic sealing rings 90 and 92, respectively, so that pistons 74 and 76 are vertically displaceable and guided in an inclinable or tiltable manner within cylinder bore holes 66 and 68, respectively, and pocket bore holes 70 and 72, respectively.

Cylinder bore holes 66 and 68 are sized such that pistons 74 and 76 may extend completely therethrough. In this manner, the hydraulic pressure of cylinder/piston subunits 28 and 30 acts directly upon press shoe 16.

Axial seals 94 and 96 seal cylinder bore holes 66 and 68, respectively, on the underside of press shoe 16. Pressed-in retaining rings 98 and 100 are associated with cylinder bore holes 66 and 68, respectively to facilitate mounting axial seals 94 and 96.

A plurality of force elements 22, aligned transversely to web run direction L and each including cylinder/piston subunits, are supplied with pressure oil via an oil supply channel 102 and through bore holes 104 that connect them. The pressure oil supply to cylinder/piston subunits 28 and 30 that enables the tilt moment to be produced is directed through connection channels 106 and 108 and bore holes 110 and 112.

Channels 102, 106, and 108, and bore hole 104 may be provided or formed in a distributor strip 114 inserted or embedded in a groove or recess 116 in carrier 20. Distributor strip 114 may be coupled, e.g., bolted, to carrier 20. Elastic seals 118 are positioned to seal off or isolate the various pressure chambers from each other.

Figure 3:
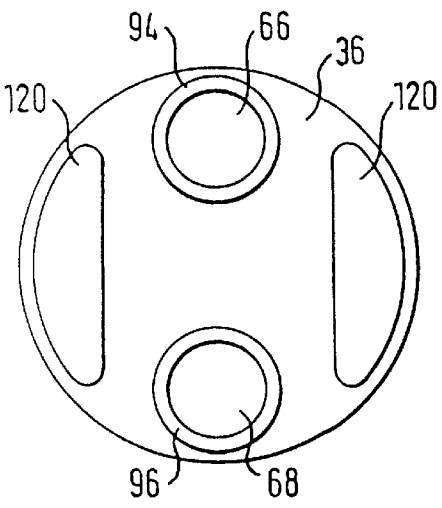
FIG. 3 illustrates a schematic top-view of a pressing piston of the shoe press unit.

FIG. 3 illustrates a top-view of pressure piston 36 of a shoe press unit 10. In this exemplary figure, cylinder bore holes 66 and 68 clearly depicted, as are axial (front) seals 94 and 96. Further, pressure piston 36 may include sliding plates 120 that are to be pressed against press shoe 16.

Figure 4:
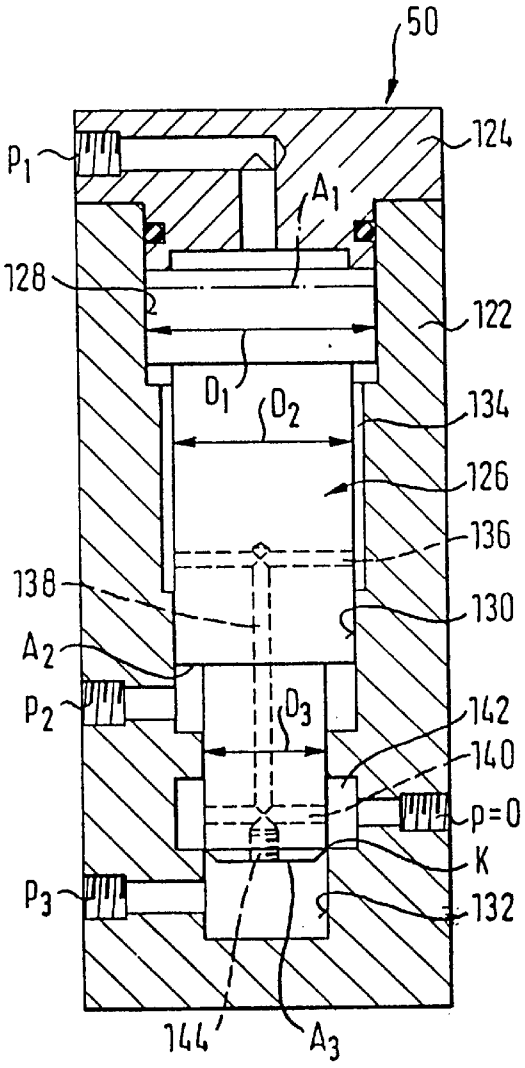
FIG. 4 illustrates a schematic, partially sectioned side-view of an embodiment of an addition valve for tilt regulation.

FIG. 4 illustrates a schematic, partially sectioned side-view of an exemplary embodiment of addition valve 50 for providing tilt control. Addition valve 50 includes a valve block 122 and a lid 124. Lid 124 is axially coupled to valve block 122, e.g., with bolts or screws, however, the specific coupling is not depicted in the section layer.

A step piston 126, which may be located within valve block 122, includes three segments having different diameters $D_1$, $D_2$, and $D_3$. The three segments $D_1$, $D_2$, and $D_3$ are designed to fit within cylinder bore holes 128, 130 and 132, respectively, in a sealing manner and are designed to be vertically displaceable within valve block 122.

A ring chamber 134 is formed to surround middle piston segment having diameter $D_2$ and is coupled, via bore holes 136, 138, and 140 to an unpressurized chamber 142 for excess oil. A screw 144 may be utilized to close bore hole 138 downwards.

Ring-shaped piston surface $A_2$, formed between the piston segment having diameter $D_2$ and the piston segment having diameter $D_3$, is substantially equal to round piston surface $A_3$, formed on the lower front end of the piston segment having diameter $D_3$. Further, the diameters $D_2$ and $D_3$ may be related such that $$\frac{D_2}{D_3} = \sqrt{2}.$$

Diameter $D_1$ may be arbitrarily selected.

As shown in FIG. 4, upper round piston surface $A_1$, formed by the piston segment having diameter $D_1$, is subject to pressure $p_1$ of pressure chamber 26 (see also FIG. 1), a pressure $p_2$ imparted upon cylinder/piston 30 is exerted upon ring piston surface $A_2$ and pressure $p_3$ imparted upon cylinder/piston subunit 28 is exerted on round piston $A_3$.

The larger the selected diameter $D_1$ is, the greater the pressures in cylinder/piston subunits 28 and 30 will be. Accordingly, diameter $D_1$ will generally be selected to be as large as possible to provide technically manageable pressure levels for cylinder/piston subunits 28 and 30. Pressure $p_2$ imparted upon cylinder/piston subunit 30 may be preset, e.g., by pressure governor 48. As discussed with regard to FIG. 1, pressure governor 48 may be formed by a pressure governor valve. Pressure $p_3$ imparted upon cylinder/piston subunit 28 may adjust itself by draining oil to a regulating edge K so that the following relationship $p_1 \cdot A_1 = p_2 \cdot A_2 + p_3 \cdot A_3$ is maintained.

Figure 5:
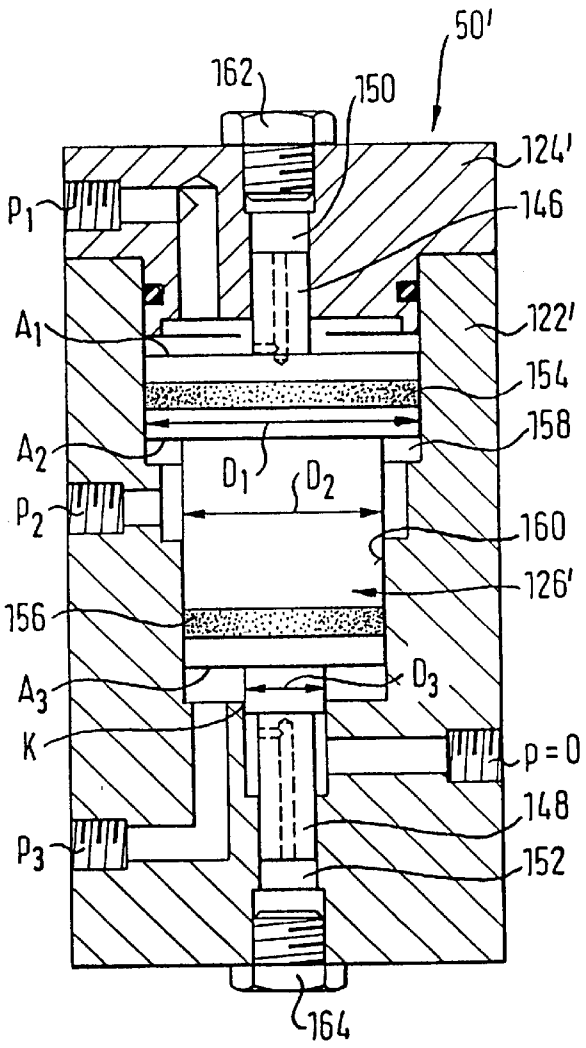
FIG. 5 illustrates a schematic, partially sectioned side-view of another embodiment of an addition valve.

FIG. 5 illustrates an alternative exemplary embodiment of a schematic, partially sectioned side-view of an addition valve 50'. Addition valve 50' may include a valve block 122' coupled to a lid 124', e.g., by bolts. Step piston 126' with diameters $D_1$, $D_2$, and $D_3$ may be located within valve block 122'.

Step piston 126' may be provided with guiding pins 146 and 148 extending from a top of the piston segment having a diameter $D_1$ and from a bottom of the piston segment having a diameter $D_3$, respectively. Guiding pins 146 and 148 may be arranged to be vertically displaceable within a bore hole 150 in lid 124' and within a bore hole 152 in valve block 122', respectively. Step piston 126' may be provided with sealing rings 154 and 156 that run within cylindrical bore holes 158 and 160 of valve block 122'. Bore holes 150 and 152 are closed at their ends by screws 162 and 164, respectively.

Pressure $p_2$ may be preset by pressure governor 48. In the present embodiment, pressure $p_2$ is exerted on ring piston surface $A_2$ formed between the piston segment with the diameter $D_1$ and the piston segment with the diameter $D_1$. A chamber defined by bore hole 152, i.e., between guiding pin 148 and screw 164, is kept unpressurized. Pressure $p_3$ adjusts itself through a running off of oil to regulating edge K, such that the relationship $p_1 \cdot A_1 = p_2 \cdot A_2 + p_3 \cdot A_3$ is maintained.

Figure 6:
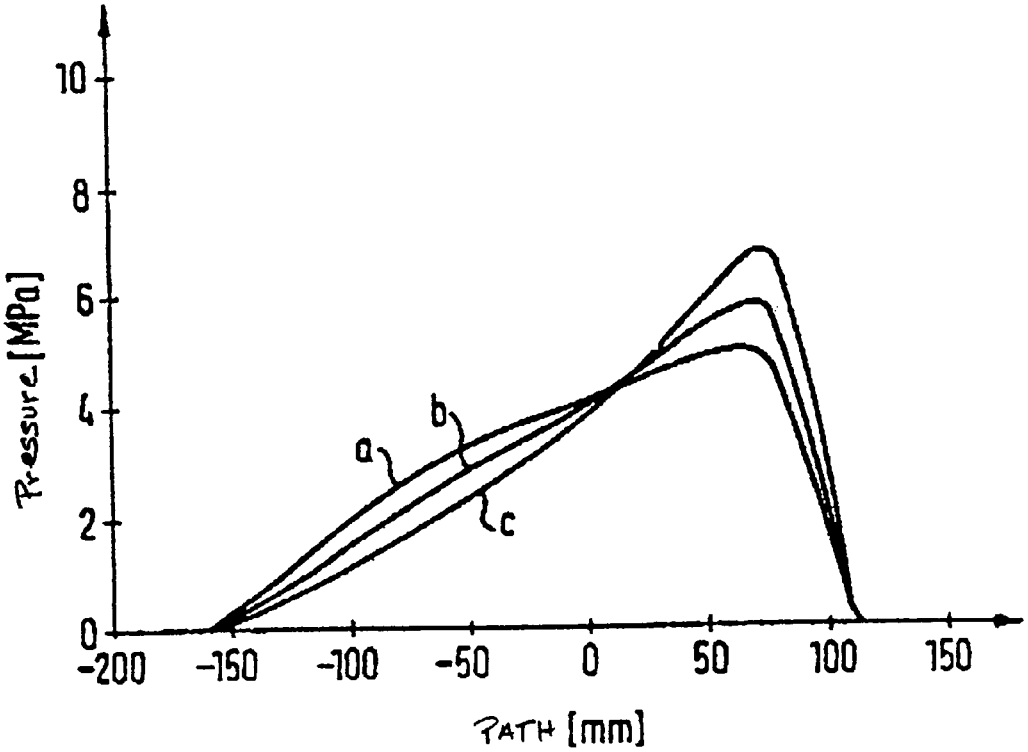
FIG. 6 illustrates the resulting pressure profile for three different tilt adjustments in the press zone in web run direction with an ageing factor of the felting of 1.0.

In FIG. 6, resulting pressure profiles in a practical embodiment for three different tilt adjustments a, b, and c in press zone 14 in web run direction L are depicted with an aging factor of 1.0 for the provided felting. Thus, the path through press zone 14 along web run direction L is shown in millimeters on the abscissa and the pressure in MPa on the coordinate. The aging factor indicates how much the compressibility of the felt has reduced relative to its original (manufactured) condition.

Figure 7:
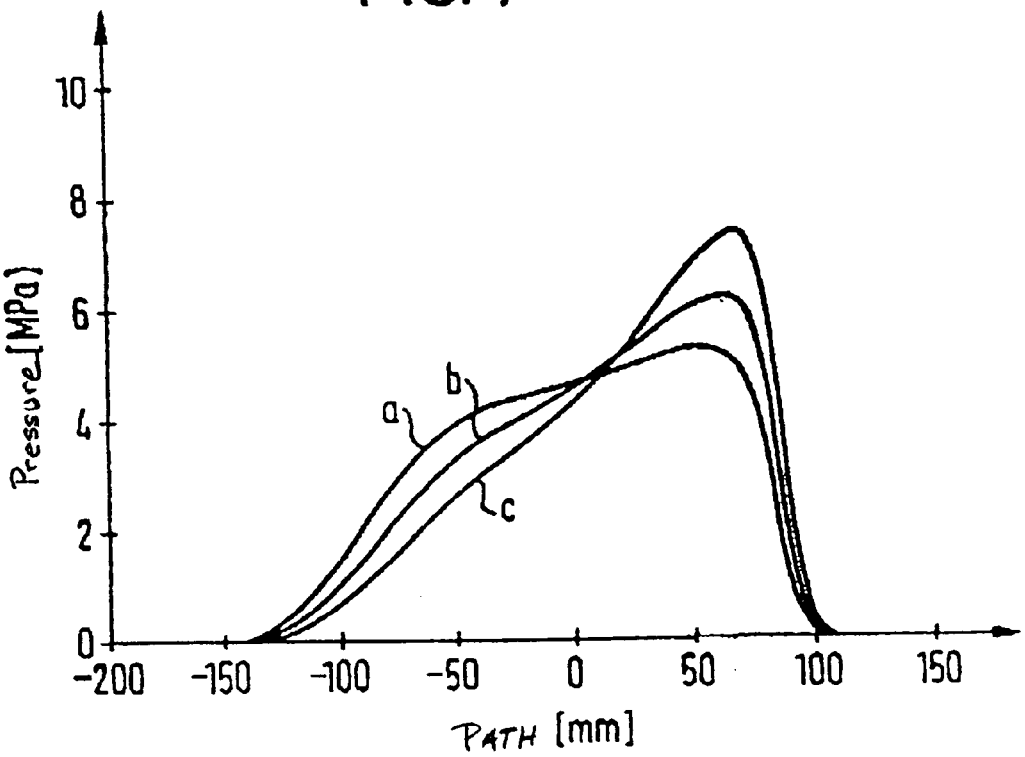
FIG. 7 illustrates the resulting pressure profile in the web run direction for three different tilt adjustments in the press zone with an ageing factor of the felting of 0.3.

FIG. 7 illustrates corresponding pressure profiles with an embodiment comparable to that depicted in FIG. 6 except with an aging factor of 0.3 for the provided felting.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A shoe press unit for treatment of a fibrous pulp web comprising:

at least one press shoe;

an opposing surface;

a flexible press belt guided over the press shoe;

at least one force element composed of a cylinder/piston unit supported on a carrier, the at least one force element being adapted to press the press belt against the opposing surface to form a press zone elongated in a web run direction;

the cylinder/piston unit comprising a pressure chamber having at least one pair of cylinder/piston subunits successively positioned in the web run direction; and pressure fluid lines coupled to respective ones of the at least one pair of cylinder/piston subunits to separately supply pressure fluid to each cylinder/pressure subunit to impart a tilting moment along a tilt axis substantially perpendicular to the web run direction, the pressure chamber being connected to a separate pressure fluid source to separately supply pressure fluid to the pressure chamber.

2. The shoe press unit in accordance with claim 1, the at least one pair of cylinder/piston subunits being integrally formed in the at least one force element.

3. The shoe press unit in accordance with claim 1, the at least one pair of cylinder/piston subunits comprising a plurality of pairs of cylinder/piston subunits adjacently positioned transversely to the web run direction to form two rows of cylinder/piston subunits successively arranged in the web run direction.

4. The shoe press unit in accordance with claim 3, a respective row of the plurality of pairs of cylinder/piston subunits being coupled to a common pressure fluid line.

5. The shoe press unit in accordance with claim 1, further comprising a control device that maintains a fluid pressure of the pressure fluid supplied to both subunits of a respective pair of cylinder/piston subunits so that a sum of the fluid pressures is constant.

6. The shoe press unit in accordance with claim 1, wherein, of the entire force exerted by the at least one press shoe, less than the entire force is exerted by the cylinder/piston subunits.

7. The shoe press unit in accordance with claim 6, wherein at most approximately 25% of the entire force is exerted by the cylinder/piston subunits.

8. The shoe press unit in accordance with claim 6, wherein between approximately 7.5% to 15% of the entire force is exerted by the cylinder/piston subunits.

9. The shoe press unit in accordance with claim 1, further comprising a control device that maintains a fluid pressure of the pressure fluid supplied to both subunits of a respective pair of cylinder/piston subunits so that a relationship between a fluid pressure acting on the pressure chamber of the at least one force element and a sum of the fluid pressures supplied to both subunits of the respective pair of cylinder/piston subunits is constant.

10. The shoe press unit in accordance with claim 1, the at least one force element comprising a pressing piston having a cylinder bore hole;

the carrier comprising a base-side pocket bore hole that is aligned with the cylinder bore hole; and a piston of the at least one pair of cylinder/piston subunits is set in the pressing piston in a tiltable and sealing manner in the base-side pocket bore hole and in the cylinder bore hole.

11. The shoe press unit in accordance with claim 10, the piston of the at least one pair of cylinder/piston subunits including a continuous flow channel that couples the base-side pocket bore hole to a segment of the cylinder bore hole.

12. The shoe press unit in accordance with claim 11, the base-side pocket bore hole and the cylinder bore hole have substantially equal diameters.

13. The shoe press unit in accordance with claim 1, a piston of the at least one pair of cylinder/piston subunits comprising an axial hub formed on a carrier side of the piston.

14. The shoe press unit in accordance with claim 1, the at least one force element comprising a pressing piston having a cylinder bore hole;

the carrier comprising a base-side pocket bore that is arranged to align with the cylinder bore hole; and a piston of the at least one pair of cylinder/piston subunits comprising at least one flow channel that couples the base-side pocket bore hole at least substantially without throttling to a segment of a cylinder bore hole on the press shoe side.

15. The shoe press unit in accordance with claim 1, further comprising a base-side distribution strip that extends transversely to the web run direction and comprises pressure fluid channels; and the pressure fluid channels are coupled to supply pressure fluid to at least one of the at least one pair of cylinder/piston subunits and the pressure chamber of the at least one force element.

16. The shoe press unit in accordance with claim 15, the carrier comprising a recess extending transversely to the web run direction to receive a portion of the distribution strip; and at least a portion of the pressure fluid channels is preferably formed between the distribution strip and the interior periphery of the recess.

17. The shoe press unit in accordance with claim 1, the at least one pair of cylinder/piston subunits comprising a first and second subunit, the first and second subunits being supplied with pressure fluid through a common pressure fluid source;

the shoe press unit further comprising:

a pressure governor coupling the common pressure fluid source to the first subunit;

a flow limiter coupling the common pressure fluid source to the second subunit; and a common addition valve coupled to the first and second subunits to maintain a constant sum of fluid pressures supplied to the subunits, wherein the pressure governor controls the desired tilting moment.

18. The shoe press unit in accordance with claim 17, the addition valve is coupled to the pressure chamber of the at least one force element via a pressure fluid line with a flow regulation device, wherein the addition valve maintains substantially constant a relationship between the fluid pressure imparted upon the pressure chamber and the sum of the fluid pressures supplied to the first and second subunits.

19. The shoe press unit in accordance with claim 18, the flow regulation device comprising at least one of a flow regulator, a fixed throttle, and a throttle that is adjustable in accordance with a line force produced in the press zone.

20. The shoe press unit in accordance with claim 1, the at least one pair of cylinder/piston subunits comprising a plurality of pairs of cylinder/piston subunits adjacently positioned transversely to the web run direction to form first and second rows of cylinder/piston subunits successively arranged in the web run direction;

the first and second rows being supplied with pressure fluid through a common pressure fluid source;

the shoe press unit further comprising:

a pressure governor coupling the common pressure fluid source to the first row;

a flow limiter coupling the common pressure fluid source to the second row; and a common addition valve coupled to the first and second rows to maintain a constant sum of fluid pressures supplied to the rows, wherein the pressure governor controls the desired tilting moment.

21. The shoe press unit in accordance with claim 20, the addition valve is coupled to the pressure chamber of the at least one force element via a pressure fluid line with a flow regulation device, wherein the addition valve maintains substantially constant a relationship between the fluid pressure imparted upon the pressure chamber and the sum of the fluid pressures supplied to the first and second rows.

22. The shoe press unit in accordance with claim 21, the flow regulation device comprising at least one of a flow regulator, a fixed throttle, and a throttle that is adjustable in accordance with a line force produced in the press zone.

23. The shoe press unit in accordance with claim 1, the shoe press unit comprising a shoe press roll and a press jacket forming the flexible press belt.

24. The shoe press unit in accordance with claim 1, further comprising a pressure governor coupled to a first and second subunit of the at least one pair of cylinder/piston subunits.

25. The shoe press unit in accordance with claim 24, the pressure governor including a stepped piston element.

26. The shoe press unit in accordance with claim 25, the stepped piston element having a first, second and third surface area arranged maintain the relation:

$$p_1 \cdot A_1 = p_2 \cdot A_2 + p_3 \cdot A_3,$$

where $p_1$ represents the pressure imparted on the pressure chamber; $A_1$ represents the area of the first surface; $p_2$ represents the pressure imparted on the first subunit; $A_2$ represents the area of the second surface; $p_3$ represents the pressure imparted on the second subunit; and $A_3$ represents the area of the third surface.

27. A method for imparting a tilting moment on at least one press shoe of shoe press unit for treatment of a fibrous pulp web, the shoe press unit including the at least one press shoe, an opposing surface, a flexible press belt guided over the press shoe, at least one force element composed of a cylinder/piston unit supported on a carrier, the at least one force element to press the press belt against the opposing surface forming a press zone elongated in a web run direction, the cylinder/piston unit including a pressure chamber having at least one pair of cylinder/piston subunits successively positioned in the web run direction, and pressure fluid lines coupled to respective ones of the at least one pair of cylinder/piston subunits, the method comprising:

supplying a pressure fluid to a first and second pressure fluid line from a common pressure fluid source at a source pressure;

supplying pressure fluid through the first pressure fluid line at a first fluid pressure to a first subunit of the at least one pair of cylinder piston subunits;

supplying pressure fluid through the second pressure fluid at a second fluid pressure to a second subunit of the at least one pair of cylinder piston subunits; and maintaining a sum of the first and second fluid pressures to be substantially equal to the source pressure.

28. The method in accordance with claim 27, further comprising:

separately supplying a pressure fluid at a chamber fluid pressure to the pressure chamber.

29. The method in accordance with claim 28, further comprising:

maintaining a relationship between the chamber fluid pressure and the sum of the first and second fluid pressures supplied to the first and second subunits.

30. The method in accordance with claim 27, further comprising:

arranging a plurality of pairs of cylinder/piston subunits transverse to the web run direction to form first and second rows of cylinder/piston subunits successively arranged in the web run direction;

supplying the pressure fluid to the first and second rows from the common pressure fluid source at the source pressure;

supplying the pressure fluid at the first fluid pressure to the first row;

supplying pressure fluid at the second fluid pressure to the second row; and maintaining a sum of the first and second fluid pressures to be substantially equal to the source pressure.

31. The method in accordance with claim 30, further comprising:

supplying a pressure fluid at a chamber fluid pressure to each pressure chamber associated with the subunits from a separate pressure fluid source; and maintaining a relationship between the chamber fluid pressure and the sum of the first and second fluid pressures supplied to the first and second rows.

32. The method in accordance with claim 27, wherein, of an entire force exerted by the at least one press shoe, less than the entire force is exerted by the cylinder/piston subunits.

33. The method in accordance with claim 32, imparting at most approximately 25% of the entire force with the cylinder/piston subunits.

34. The method in accordance with claim 32, imparting between approximately 7.5% to 15% of the entire force with the cylinder/piston subunits.

35. A shoe press unit for treatment of a fibrous pulp web comprising:

at least one press shoe;

an opposing surface;

a flexible press belt guided over the press shoe;

at least one force element composed of a cylinder/piston unit supported on a carrier, the at least one force element being adapted to press the press belt against the opposing surface to form a press zone elongated in a web run direction;

the cylinder/piston unit comprising a pressure chamber having at least one pair of cylinder/piston subunits successively positioned in the web run direction, each of the cylinder/piston subunits being entirely within the pressure chamber; and pressure fluid lines coupled to respective ones of the at least one pair of cylinder/piston subunits to separately supply pressure fluid to each cylinder/pressure subunit to impart a tilting moment along a tilt axis substantially perpendicular to the web run direction.

* * * * *